United States Patent [19]

Inagaki

[11] Patent Number: 4,530,815

[45] Date of Patent: Jul. 23, 1985

[54] METHOD OF PRODUCING A CONTACT DEVICE FOR A SWITCH

[75] Inventor: Kouichi Inagaki, Itami, Japan

[73] Assignee: Mitsubishi Denki Kabushiki Kaisha, Japan

[21] Appl. No.: 508,160

[22] Filed: Jun. 27, 1983

[30] Foreign Application Priority Data

Jun. 29, 1982 [JP] Japan ..... 57-114259
Dec. 1, 1982 [JP] Japan ..... 57-212410

[51] Int. Cl.[3] ..... B22F 7/04; B22F 3/16

[52] U.S. Cl. ..... 419/8; 419/38; 419/47

[58] Field of Search ..... 419/5, 6, 8, 9, 38, 419/47, 26

[56] References Cited

U.S. PATENT DOCUMENTS

| | | | |
|---|---|---|---|
| 3,124,455 | 3/1964 | Buehler et al. | 419/8 |
| 3,366,463 | 1/1968 | Schreiner | 419/5 |
| 3,373,003 | 3/1968 | Schreiner | 419/6 |
| 3,385,677 | 5/1968 | Schreiner et al. | 419/6 |
| 3,489,531 | 1/1970 | Schreiner et al. | 419/6 |
| 3,770,497 | 11/1973 | Hassler et al. | 117/212 |
| 3,828,428 | 8/1974 | Wayland | 29/630 C |
| 3,863,337 | 2/1975 | Schreiner et al. | 29/630 C |
| 4,008,520 | 2/1977 | Rothkegel et al. | 419/6 |
| 4,025,313 | 5/1977 | Slaats | 419/8 |
| 4,195,764 | 4/1980 | Bogart | 419/8 |
| 4,293,619 | 10/1981 | Landingham et al. | 419/8 |

*Primary Examiner*—Edward A. Miller
*Assistant Examiner*—Howard J. Locker
*Attorney, Agent, or Firm*—Leydig, Voit, Osann, Mayer and Holt, Ltd.

[57] ABSTRACT

A novel method of producing a contact device for a switch is disclosed. According to the present invention, a powdered contact alloy material is pressed with a substrate on which is placed the contact material. The resulting molded article is sintered for bonding said contact alloy material to said substrate. The resulting sintered product is machined to have the shape of a contact and ultimately an electrode bar is attached by brazing to said substrate.

6 Claims, 6 Drawing Figures

METHOD OF PRODUCING A CONTACT DEVICE FOR A SWITCH

BACKGROUND OF THE INVENTION

This invention relates to a method of producing a contact device for a switch, especially a vacuum switch, in which the contact alloy is formed by powder sintering.

According to the method of powder sintering, several kinds of metal powders or intermetallic compounds are used as a starting material and are thoroughly mixed by mechanical means. The resulting mixture is pressed at a predetermined molding pressure and sintered within a high-temperature atmosphere to become a sintered body for use as a contact alloy material. The sintered body thus obtained is machined to have a desired shape and brazed to a substrate made of copper or the like electrically conductive material thus completing the contact device.

For attaching the contact to the substrate, soldering is usually resorted to by using a hard solder of the Cu-Ag type or Cu-Au type under vacuum or in a hydrogen atmosphere. However, since the hard solder does not fuse well with the contact alloy, the conventional practice is by etching the bonding surface of the contact or by depositing a more adhesive coating layer on the bonding surface of the contact through vacuum metallization.

In order to avoid deterioration of the contact performance due to contamination of the operating contact surface with the coating layer or the ethching liquid, the surface of the contact need be masked except for the surface to be bonded to the substrate by hard soldering. However, in spite of the additional time and labor involved in the masking operation, it has not been possible to realize a sufficient bonding strength between the contact and the substrate. On the other hand, when the contents of low melting metals, such as Bi, in an alloy are increased to be higher than 0.5 percent with the object of improving the welding resistance of the contact and reducing the chopping current produced by the on/off contact operation, the solderability of the alloy is necessarily reduced.

A device shown in FIG. 1 has been used in the prior art for holding the contact in position. In the figure, a contact 1 formed with a lower flange 2 is placed on a substrate 3 and an annular mounting member 4 is fitted and brazed to the substrate 3 for securing the contact 1 thereto. Numeral 5 designates an electrode brazed to the substrate, and numeral 6 designates a brazing layer or a layer of hard solder.

In the construction shown in FIG. 1, the contact 1 can be held in place when a material that fuses well with hard solder is used for the substrate 3 and the lower flange 2. However, since the bonding between the contact 1 and the substrate 3 is not improved in this case, the holding device tends to be complicated in structure.

FIG. 2 shows another system for holding the contact in position. In the figure, a groove 7 is formed on sides of the contact 1, and the end of a mounting member 8 is bent and caulked in the groove 7 for holding the contact 1. The mounting member 8 is brazed to the substrate 3. Numeral 6 designates a layer of hard solder. With this system, the bonding between the contact 1 and the substrate 3 is not improved. In addition, the contact 1 tends to become detached from the substrate 3 when the caulking of the mounting member 7 is loosened during the use of the contact.

SUMMARY OF THE INVENTION

The present invention has been made to eliminate the aforementioned drawbacks of the prior-art contact device and to provide an improved contact device. More specifically, the present invention is directed to a method of producing a contact device without resorting to brazing for bonding the contact and the substrate to each other.

BRIEF DESCRIPTION OF THE DRAWINGS

In the drawings, the same numerals depict the same or equivalent parts.

DESCRIPTION OF THE PREFERRED EMBODIMENTS

Figure 3:
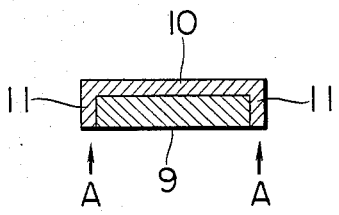
FIG. 3 is a cross-sectional side elevation view showing a molded article produced by a method according to the present invention.

FIG. 3 shows a molded article of the contact device according to the present invention, that is, a composite molded article obtained by placing a pulverulent mixture of the contact material of predetermined ingredients on the main surface of a pre-existing solid copper base or substrate pedestal 9 and pressing the mixture and the substrate together. Numeral 10 designates a contact obtained upon molding and having a flange 11 which is intimately contacted with the rim of the substrate 9. By the presence of the flange 11, the contact 10 and the substrate 9 may be prevented from separating from each other during manufacture up to the sintering step. After sintering, the contact 10 is contracted uniformly and bonded strongly to the substrate 9. The substrate 9 has an irregular upper surface for enhancing the contact area with the contact 10 and improving the bonding strength posterior to molding and sintering.

In the aforementioned manufacture process, the contact 10 and the substrate 9 are bonded together by sintering. Thus the present invention is accomplished in view of the following two points with respect to the manufacture of the contact device without brazing.

Figure 1:
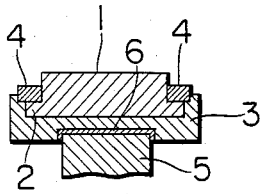
FIG. 1 PRIOR ART
FIG. 1 is a cross-sectional side elevation view showing a contact device produced by a conventional method.

The first point is that, when a molded contact article obtained by pressing a powdered contact alloy material is placed on a substrate of copper or the like conductive material and sintered therewith in a hydrogen atmosphere at a solidifying temperature of the powdered contact material, the copper substrate and the sintered contact body are bonded partially to each other by seizure. It is therefore necessary to solve the problem of how to realize a complete bonding instead of partial bonding. The second point is that a difference is present in the coefficient of contraction of the contact article and the copper substrate at the time of sintering. Such a difference in the coefficient of contraction must be overcome in order to obtain an optimum bonding between the contact and the base. In the present invention, when the powdered contact material is pressed as in the prior-art example shown in FIG. 1, the material is pressed and molded along with the base in such a manner that the aforementioned two points may be solved. The present method will be explained in more detail below in connection with several experimental examples.

Figure 4:
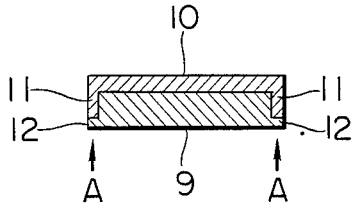
FIG. 4 is a cross-sectional side elevation view showing another molded article produced by a modified method embodying the present invention.

FIG. 4 shows a modified embodiment of the present invention wherein the contact and the base are positively safeguarded against accidental separation prior to the sintering process. Thus, in instances where more than 10% of adhesive metal oxides such as $Bi_2O_3$ are contained in the powdered contact material, the contact material and the base do not adhere well to each other prior to sintering.

Hence, when subjected to a mechanical shock in the direction of the arrow marked A in FIG. 3, the contact material may peel off from the base. This may be avoided by a modified embodiment shown in FIG. 4.

The base 9 is formed in the shape of a disc having a lower annular lug 12 on which rests the lower end of the flange 11 of the contact 10. In the present embodiment, the contact 10 does not peel off from the pedestal 9 when subjected to a mechanical shock acting in the direction of the arrow mark prior to sintering. In addition, the contact may be bonded strongly to the pedestal as a result of uniform contraction after sintering.

Figure 5:
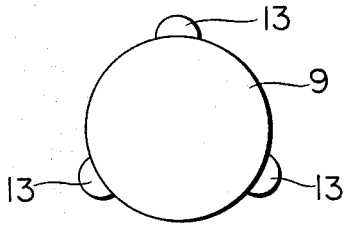
FIG. 5 is a plan view of a substrate modified from the substrate employed in the embodiment of FIG. 4.

FIG. 5 shows a modification in which the base in the form of the disc has been modified from the embodiment shown in FIG. 4. Thus, in the embodiment shown in FIG. 4, the lug 12 is formed concentrically with the base 9. In FIG. 5, the annular lug is replaced by a plurality of peripheral projections 13 radially coextensive with the outer rim of the contact flange 11. The effect of the embodiment shown in FIG. 5 is the same as that of the preceding embodiment.

Figure 2:
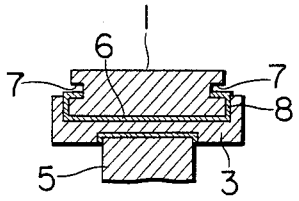
FIG. 2 PRIOR ART
FIG. 2 is a cross-sectional side elevation view showing another contact device produced by another conventional method.
Figure 6:
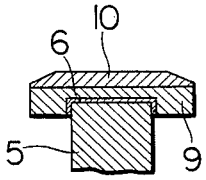
FIG. 6 is a cross-sectional side elevation view showing the completed contact device according to the present invention.

FIG. 6 shows a contact device obtained by sintering the composite article obtained in accordance with any of the preceding embodiments, machining the sintered material to the shape of a contact and brazing an electrode bar 6 to the resulting contact. In the figure, numeral 9 designates a base, numeral 10 a contact, numeral 5 an electrode bar and numeral 6 a hard solder layer. Contrary to the prior art shown in FIGS. 1 and 2, it is no longer necessary to provide special supporting means for supporting the contact by the substrate. Thus the contact 10 may have a minimum thickness which is determined in consideration of thermal capacity and consumption of the contact material.

The present invention will be described further with reference to several experimental examples in which the composite molded article composed of various pulverulent contact materials and alloys are sintered under varying operating conditions.

Experimental Example 1

A 75 Cu - 25 Cr alloy was used as the powdered contact material. A copper alloy substrate with a size 41.5 mm in diameter and 5 mm in thickness and a surface roughness of less than 6.3 S was used. The contact and the base were molded at a pressure of 5 ton/cm$^2$ and the composite molded article was sintered at 1060° C. The sintered density ratio as measured at the contact layer was 98 percent. The bonding state of the sintered product was satisfactory.

Experimental Example 2

A 55 Cu - 25 Cr - 20 Bi alloy was used as the powdered contact material. A copper alloy substrate with a size of 40 mm in diameter and 5 mm in thickness and a surface roughness of less than 6.3 S was used. The contact and the copper base were molded at a molding pressure of 8 ton/cm$^2$ and the molded composite product was sintered at a temperature of 960° C. The sintered density ratio as measured at the contact layer was equal to 96 percent. The bonding strength of the sintered product was good or bad respectively depending on whether the substrate and the contact were molded concentrically to each other or not.

Experimental Example 3

A 55 Cu - 25 Cr - 20 Bi alloy was used as the contact material. A copper alloy base with a size of 40 mm in diameter and 5 mm in thickness and a surface roughness in the range of 25 to 50 S was used. The contact and the base were molded at a molding pressure of 8 ton/cm$^2$ and the resulting molded product was sintered at a temperature of 960° C. The sintered density ratio as measured at the contact layer was equal to 96 percent. The bonding state of the sintered product was satisfactory.

Experimental Example 4

A 55 Cu - 25 Cr - 20 Bi alloy was used as the contact material. A copper alloy substrate with a size of 40 mm in diameter and 5 mm in thickness and a surface roughness of less than 6.3 S, and having three projections each being 42 mm in diameter 1 mm in thickness and (FIG. 6) was used. The contact and the base were molded at a pressure of 8 ton/cm$^2$, and the composite molded article was sintered at a temperature of 960° C. The contact layer of the resulting sintered product showed the sintered density ratio equal to 96 percent. The bonding state of the sintered product was satisfactory.

Experimental Example 5

A 55 Cu - 25 Cr - 20 Bi alloy was used as the contact material. A copper alloy substrate with a size of 40 mm in diameter and 5 mm in thickness in the body portion and a size of 42 mm in diameter and 1 mm in thickness in the lug 12 (FIG. 4) was used. The surface roughness of the base was lower than 6.3 S. The contact and the base were molded together at a molding pressure of 8 ton/cm$^2$. The resulting molded product was sintered at a temperature of 960° C. The sintered density as measured at the contact layer was 96 percent. The bonding strength of the sintered product was satisfactory.

Experimental Example 6

A 55 Cu - 25 Cr - 20 $Bi_2O_3$ alloy was used as the contact material. A copper alloy substrate with a size of 39 mm in diameter and 5 mm in thickness and a surface roughness lower than 6.3 S was used. The molding pressure of 8 ton/cm$^2$ and the sintering temperature of 990° C. were used. The sintered density as measured at the contact layer was 95 percent. The bonding state of the sintered product was not satisfactory.

Experimental Example 7

A 55 Cu - 25 Cr - 20 $BiO_3$ alloy was used as the contact material. A copper alloy substrate 39 mm diameter and 5 mm thickness and showing a surface roughness in the range of 6.3 S was used. The molding pressure of 8 ton/cm$^2$ and the sintering temperature of 990° C. were used. The sintered density as measured at the contact layer was 95 percent. The bonding state was good or bad, respectively, depending on whether the substrate and the contact were molded concentrically to each other or not.

Experimental Example 8

A 55 Cu - 25 Cr - 20 $BiO_3$ alloy was used as the contact material. A copper alloy substrate with a size of 39 mm diameter and 5 mm thickness in the body portion, and 42 mm diameter and 1 mm thickness in the three radial projections (FIG. 5) and which has a surface roughness lower than 6.3 S was used. The molding pressure of 8 ton/cm$^2$ and the sintering temperature of 990° C. were used. The sintered density ratio at the contact layer was 95%. The bonding state was not satisfactory.

Experimental Example 9

A 55 Cu - 25 Cr - 20 $BiO_3$ alloy was used as the contact material. A copper alloy substrate with a size of 39 mm in diameter and 5 mm in thickness in the body portion, and 42 mm in diameter and 1 mm in thickness in the three radial projections (FIG. 5) and which has a surface roughness in the range of 25 to 50 S was used. The molding pressure of 8 ton/cm$^2$ and the sintering temperature of 990° C. were used. The sintered density ratio at the resulting contact layer was 95 percent. The bonding state of the sintered article was satisfactory.

Experimental Example 10

A 55 Cu - 25 Cr - 20 $Bi_2O_3$ alloy was used as the contact material. A copper alloy substrate with a size of 39 mm in diameter and 1 mm in thickness in the body portion, and 42 mm in diameter and 1 mm in thickness in the lug portion (FIG. 4) and having a surface roughness lower than 6.3 S was used. The contact material and the base were molded at a molding pressure of 8 ton/cm$^2$. The resulting molded article was sintered at a temperature of 990° C. The sintered density at the contact layer was 95 percent. The bonding state was satisfactory.

Although the description has been made for the case in which the electrically conductive substrate is made of copper, it is to be noted that similar effects may be derived by using other electrically and thermally conductive metals, such as aluminium or silver. In addition, in consideration of thermal effects caused by current interruption, it is preferred to use an inexpensive alloy as substrate material, said alloy showing good brazing properties and having a coefficient of thermal expansion which is proximate to that of the contact material.

What is claimed is:

1. A method of producing a contact device for a switch comprising the steps of:

placing a powdered alloy contact material directly on a main surface and concentrically of a pre-existing disc-shaped substrate pedestal of electrically conductive solid copper or copper alloy metal material and pressing said material and substrate pedestal to form a unitarily molded product;

sintering said molded product at an elevated temperature no higher than about 1,060 degrees C. to solidify said powdered alloy contact material and to obtain a complete bonding state between said alloy contact material and said substrate pedestal material;

machining the sintered product to a desired shape; and brazing an electrode bar to said substrate pedestal.

2. The method as claimed in claim 1 wherein said substrate pedestal is formed as a disc and said contact alloy material is formed to have a lug intimately contacted with the lateral side of said substrate.

3. The method as claimed in claim 1 wherein said substrate pedestal is formed as a disc having a flange integrally formed therewith, and wherein said alloy contact material has a flange conforming to the shape of the side surface and the lug of said substrate.

4. The method as claimed in claim 1 wherein said substrate pedestal is formed as a disc having radially extending lower projections, and wherein said alloy contact material has a flange conforming to the shape of the side surface and projections of said substrate.

5. The method as claimed in claim 1 wherein said substrate pedestal has an irregular surface for augmenting the bonding thereof with said contact alloy material.

6. The method as claimed in claim 1 wherein said contact alloy material contains more than 0.5 percent of a low melting metal and wherein said substrate pedestal is made of an electrically conductive material selected from the group consisting of copper, copper alloy, silver and aluminium.

* * * * *